US006159106A

United States Patent [19]

Adams

[11] Patent Number: 6,159,106

[45] Date of Patent: Dec. 12, 2000

[54] PUTTING STROKE TRAINING DEVICE

[76] Inventor: Harold Adams, 13798 Bellbrook Dr., Brook Park, Ohio 44142-2619

[21] Appl. No.: 09/393,856

[22] Filed: Sep. 9, 1999

Related U.S. Application Data

[63] Continuation-in-part of application No. 09/259,386, Feb. 26, 1999, abandoned.

[51] Int. Cl.[7] ..... A63B 69/36

[52] U.S. Cl. ..... 473/265; 473/260; 434/252

[58] Field of Search ..... 473/265, 229, 473/150, 159, 172, 260, 261; 434/252

[56] References Cited

U.S. PATENT DOCUMENTS

| | | | |
|---|---|---|---|
| 3,718,333 | 2/1973 | Santoro et al. | 473/159 X |
| 4,344,624 | 8/1982 | Laursen | 473/159 |
| 4,540,179 | 9/1985 | Slagle | 473/409 |
| 4,919,433 | 4/1990 | Millat | 473/229 |
| 4,984,802 | 1/1991 | Barraclough | 473/229 |
| 5,527,041 | 6/1996 | Terry, III et al. | 473/150 |
| 5,658,204 | 8/1997 | Nappi | 473/229 |
| 5,692,966 | 12/1997 | Wash | 473/221 |
| 5,788,588 | 8/1998 | Hooker | 473/409 |
| 5,797,804 | 8/1998 | Chen | 473/260 |
| 5,882,267 | 3/1999 | Roe | 473/265 |

*Primary Examiner*—Kien T. Nguyen
*Attorney, Agent, or Firm*—John D. Gugliotta

[57] ABSTRACT

Disclosed is putting stroke training device that consists of a flat base with an adjustable width channel running its length. The user adjusts the channel to a size slightly wider than that of his/her putter's head so that it will pass freely there through with a slight clearance. A ball holder located in the middle of the channel holds a golf ball in a position such that it can be struck by stroking the putter through the channel. A series of distance indicating lines along the interior of the channel allow the user to gauge the strength of the stroke, allowing them to develop a consistent stroke, while the channel ensures a straight, level stroke.

7 Claims, 6 Drawing Sheets

PUTTING STROKE TRAINING DEVICE

RELATED APPLICATIONS

The present application is a continuation in part of Ser. No. 09/259,386, filed on Feb. 26, 1999, and herein expressly abandoned.

BACKGROUND OF THE INVENTION

1. Field of the Invention

The present invention relates generally to golf, and more specifically to a teaching device that allows a user to practice and learn a proper putting stroke.

2. Description of the Related Art

The game of golf has become one the most technologically advanced sports in the world today. Experts in science and physics have combined state of the art materials with ergonomic and aerodynamic principles in order to produce golf clubs and golf balls that produce more accurate and consistently longer golf shots. In fact, 1997 saw the first golfer in PGA history to average over 300 yards per drive. As a result of the highly competitive nature of the golf equipment business, most of the big name brands introduce a new line of equipment nearly every year. However, in directing these efforts at longer, straighter golf shots, manufacturers virtually ignore the one type of shot that every single golfer uses most often—the putt. All golfers, including professionals, usually putt at least once if not more on every hole, yet manufacturers concentrate their efforts on drivers and the like, which typically are used only 14–16 times per round maximum. Boasting increased distance and the desired "monster" drives, the manufacturers ignore simple logic that dictates the most often used club is the one upon which to concentrate improvements. Accordingly, there is a need for new and innovative golf equipment that will produce accurate and more consistent putting. The development of the present invention fulfills this need.

A search of the prior art did not disclose any patents that read directly on the claims of the instant invention. However, several references to golf putting training devices were discovered. Ranging in complexity from simple racks that restrict that putting motion to that within a single spatial plane to electronic devices incorporating the use of lasers positioning devices, these devices neither anticipate nor disclose any embodiment that would preclude the novelty and the utilitarian functionality of the features of the present invention:

U.S. Pat. No. 5,788,588, issued in the name of Hooker;

U.S. Pat. No. 5,692,966, issued in the name of Wash;

U.S. Pat. No. 5,658,204, issued in the name of Nappi;

U.S. Pat. No. 4,984,802, issued in the name of Barraclough;

U.S. Pat. No. 4,919,433, issued in the name of Millat;

U.S. Pat. No. 4,540,179, issued in the name of Slagle;

U.S. Pat. No. 4,344,624, issued in the name of Laursen; and

U.S. Pat. No. 3,718,333, issued in the name of Santoro.

While several features exhibited within these references may be incorporated into this invention, alone and in combination with other elements, the present invention is sufficiently different so as to make it distinguishable over the prior art.

SUMMARY OF THE INVENTION

One of the essential components in effective putting is the ability to read the contour and slope of the green in order to determine the appropriate aim and force with which to strike the ball. The intent of this practice is that, if the ball does not hit the hole on the first attempt, it will stop at a point near the hole leaving an easy second putt. The putt consists essentially of a two-part process. First, the golfer must "read" the green in order to determine the slope and contour of the putting surface and predict the direction and path that the ball will travel. Second, the golfer must determine the appropriate stroke that will propel the ball at a speed where it will come to rest near the hole. Arguably, the later of the process, i.e. the determination of the stroke is of the utmost importance because it determines the distance of a second putt should the first miss. Because a par score for any given hole assumes two putts, the ability to leave a first putt in close proximity, ideally 2–4 feet, to the hole on a consistent basis is a giant step in developing one's game. A proper stroke, in simplest terms, consists of a smooth, level swinging of the putter at the proper speed. The smoothness and levelness of the stroke ensuring that the ball travels in the desired direction and the speed ensuring that the ball stops near the hole. The present invention aids the golfer in the putting process by teaching a proper stroke, producing consistent putt speeds in an even, level stroke. The device consists of a flat base with an adjustable width channel running its length. The user adjusts the channel to a size slightly wider than that of his/her putter's head so that it will pass freely there through with a slight clearance. A ball holder located in the middle of the channel holds a golf ball in a position such that it can be struck by stroking the putter through the channel. A series of distance indicating lines along the interior of the channel allow the user to gauge the strength of the stroke, allowing them to develop a consistent stroke, while the channel ensures a straight, level stroke. When the user can properly gauge the distance that a ball will travel when struck from within the channel, and do so without striking the sidewalls with the putter head, a proper stroke has been developed. Used on the practice green or the living room carpet, the present invention produces the consistency in the putting stroke is sure to be noticed on the scorecard.

It is therefore an object of the present invention to provide a putting stroke training device that teaches a smooth, level putting stroke.

It is another object of the present invention to provide a putting stroke training device that teaches the ability to control and determine proper and consistent putting stroke speeds.

It is another object of the present invention to provide a putting stroke training device that reduces ball top spin and side spin that results from an uneven putting stroke.

It is another object of the present invention to provide a putting stroke training device that is adjustable so as to allow for the use of virtually putter therewith.

It is another object of the present invention to provide a putting stroke training device that provides indicia by which to gauge the strength of one's putting stroke and the resulting ball speed.

Finally, it is an object of the present invention to provide a putting stroke training device that will improve one's golf score and handicap.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

LIST OF REFERENCE NUMBERS

| | | | |
|---|---|---|---|
| 20 | Putting Stroke Training Device | 40 | Golf Ball Holder |
| 21 | Base | 41 | Holder Aperture |
| 21a | Gripper Tracks | 45 | Ball Securing Area |
| 22 | Stationary Guide Wall | 46 | Stroke Strength Indicia |
| 23 | Adjustable Guide Wall | 50 | Golf Ball |
| 23a | Gripper Lever | 51 | Putter |
| 24 | Putting Channel | 52 | Golfer |
| 25 | Wall Apertures | 55 | Putter Head |
| 26 | Artificial Grass | 56 | Exit Bevel |
| 29 | Foot Guides | 57 | Golf Ball Holders |
| 30 | Locking Channel | 58 | Rubber Floor Bumpers |

DESCRIPTION OF THE PREFERRED EMBODIMENTS

1. Detailed Description of the Figures

Figure 1:
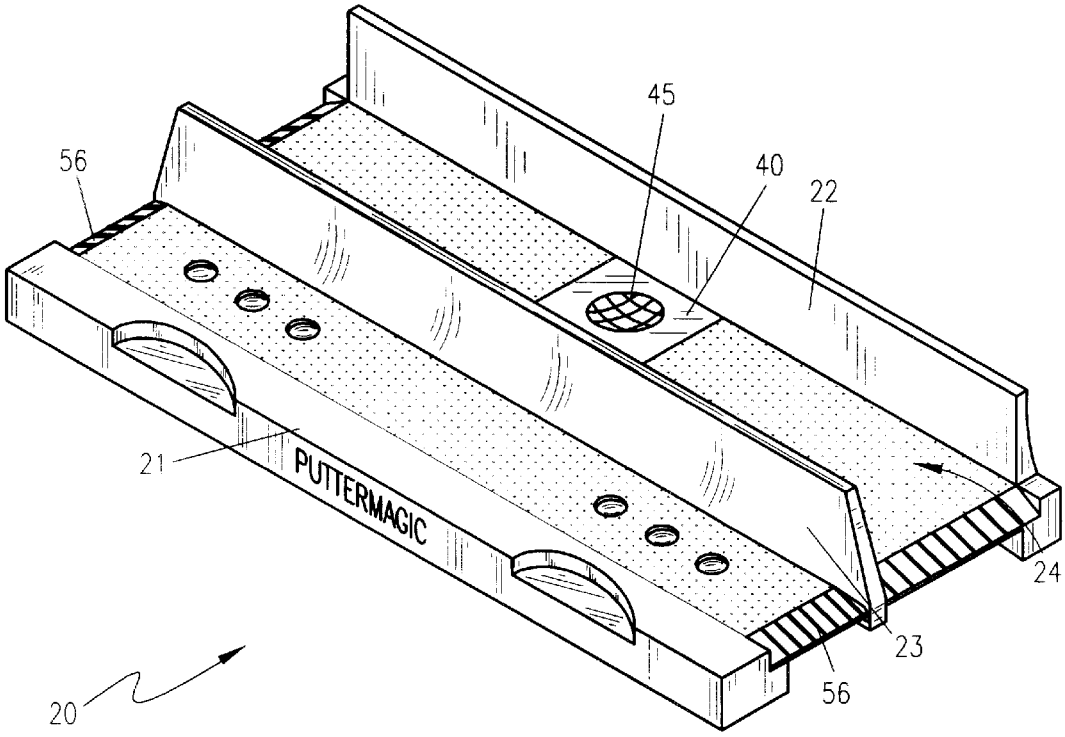
FIG. 1 is a perspective view of the putting stroke training device, according to the preferred embodiment of the present invention.
Figure 2:
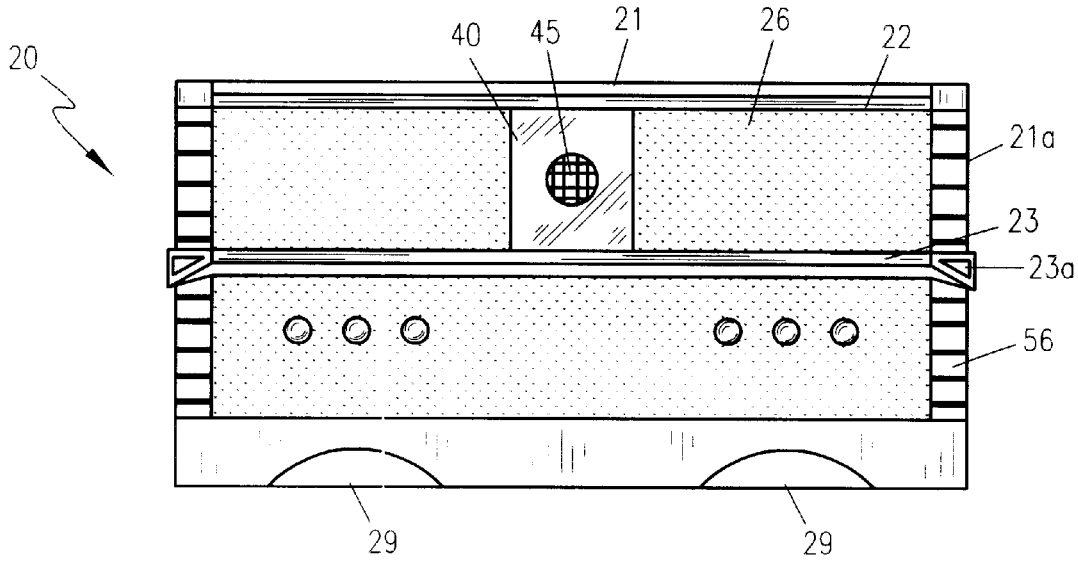
FIG. 2 is a top plan view of the putting stroke training device, according to the preferred embodiment of the present invention.
Figure 3:
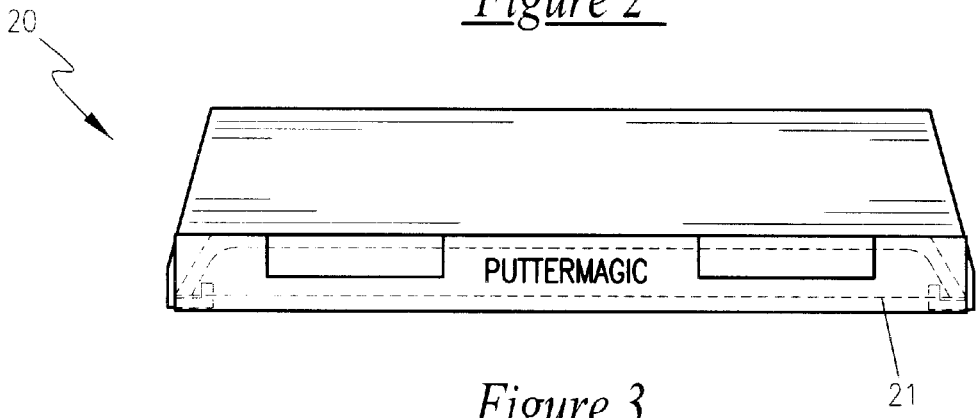
FIG. 3 is a front elevation view of the putting stroke training device, according to the preferred embodiment of the present invention.
Figure 4:
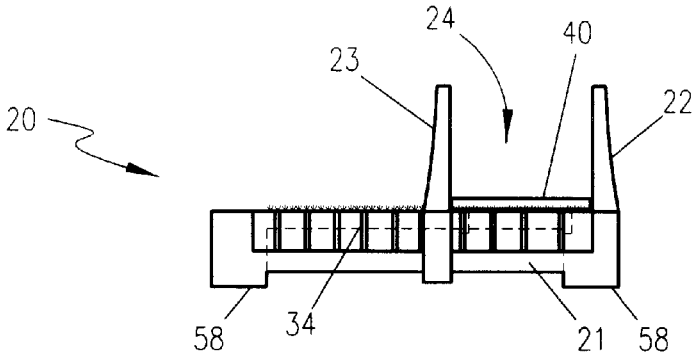
FIG. 4 is a side elevation view of the putting stroke training device, according to the preferred embodiment of the present invention.
Figure 5:
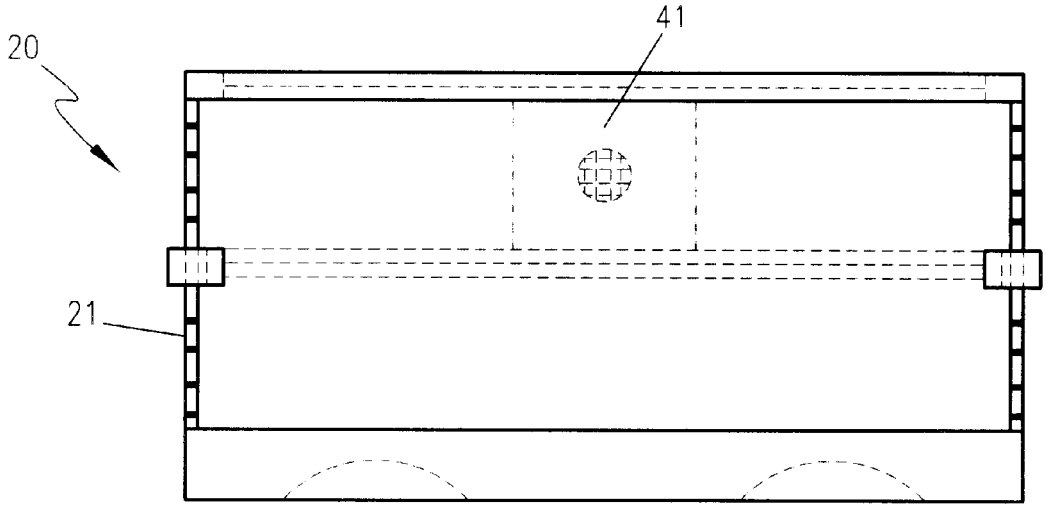
FIG. 5 is a bottom view of the putting stroke training device, according to the preferred embodiment of the present invention.

Referring now to FIGS. 1–5, depicted is the putting stroke training device 20, according to the preferred embodiment of the present invention. The putting stroke training device 20 consists of a generally rectangular base 21, constructed of molded plastic or other like suitable material, that supports a stationary guide wall 22 and an adjustable guide wall 23, both of a similar material construction. The stationary guide wall 22 and adjustable guide wall 23 are oriented parallel to one another, forming a putting channel 24 therebetween, spanning the length of the base 21 and rising perpendicularly from the surface thereof. The stationary guide wall 22 may be molded or otherwise formed as a contiguous piece with the base 21 or it may be formed separately and fastened to the base 21 via an adhesive substance or fastener. The adjustable guide wall 23 is slidably fastened to the base 20 via slotted tabs formed on its opposite ends. Spring loaded grippers 23*a* located integrally within the ends of adjustable guide wall 23 engage one of a plurality of tracks 21*a* cut into a downwardly sloping surface cut into opposite ends of base 21. The adjustable guide wall 23 slides guided by the slotted tabs engaging the base 20, maintaining a parallel orientation with respect to the stationary guide wall 22, thus adjusting the width of the putting channel 24. A plurality of four rubber floor bumpers 58 are attached to the lower surface of base 21, one of said rubber floor bumpers 58 being placed in each of said base 21 four corners to provide friction resistance to prevent base 21 from sliding when placed on the ground.

A pair of foot guides 29 are located on the base 21 along the edge opposite the stationary guide wall 22. The foot guides 29 are arcuate in shape and are designed to receive the feet of the user, teaching the proper positioning during a putting stroke.

A golf ball holder 40 is attached to the base 20 and is located within the putting channel 24 at approximately the midpoint thereof. The position of the golf ball holder 40 is adjustable, via a holder aperture 41 through which T-shaped protrusions 28 are inserted. The golf ball holder 40 is thus slidably secured within the putting channel 24, thus allowing it to be maintained in a position at or near the midpoint of the putting channel 24 cross-section. The golf ball holder 40 includes a ball securing area 45 that is designed to retain a golf ball (not shown in FIGS. 1–5) therein. The ball securing area 45 is recessed within the golf ball holder 40 and has a slightly concave shape. Stroke strength indicia 46 are marked along the surface of the base 21 within the putting channel 24, extending the length thereof, on both sides of the golf ball holder 40.

The entire upper surface of base 21 is covered with artificial grass 26 similar to "astroturf" to provide a non-slip, semi-realistic surface for putting golf balls from. The front edge of the device has "PUTTERMAGIC" inscribed in it for identification purposes.

A plurality of six circular shaped and downwardly concave apertures forming Golf Ball Holders 57 are recessed into the upper surface of base 21 placed in pairs of three located therebetween foot guides 29 and adjustable guide wall 23 for receiving and holding golf balls for storage.

2. Operation of the Preferred Embodiment

Figure 6:
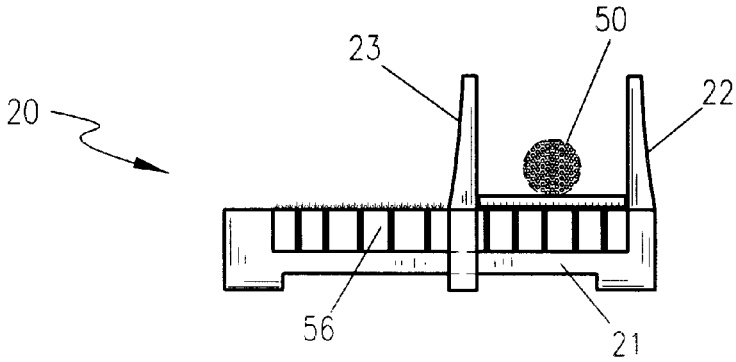
FIG. 6 is a side elevation view of the putting stroke training device, depicting its use in supporting a golf ball for training purposes, according to the preferred embodiment of the present invention.
Figure 7:
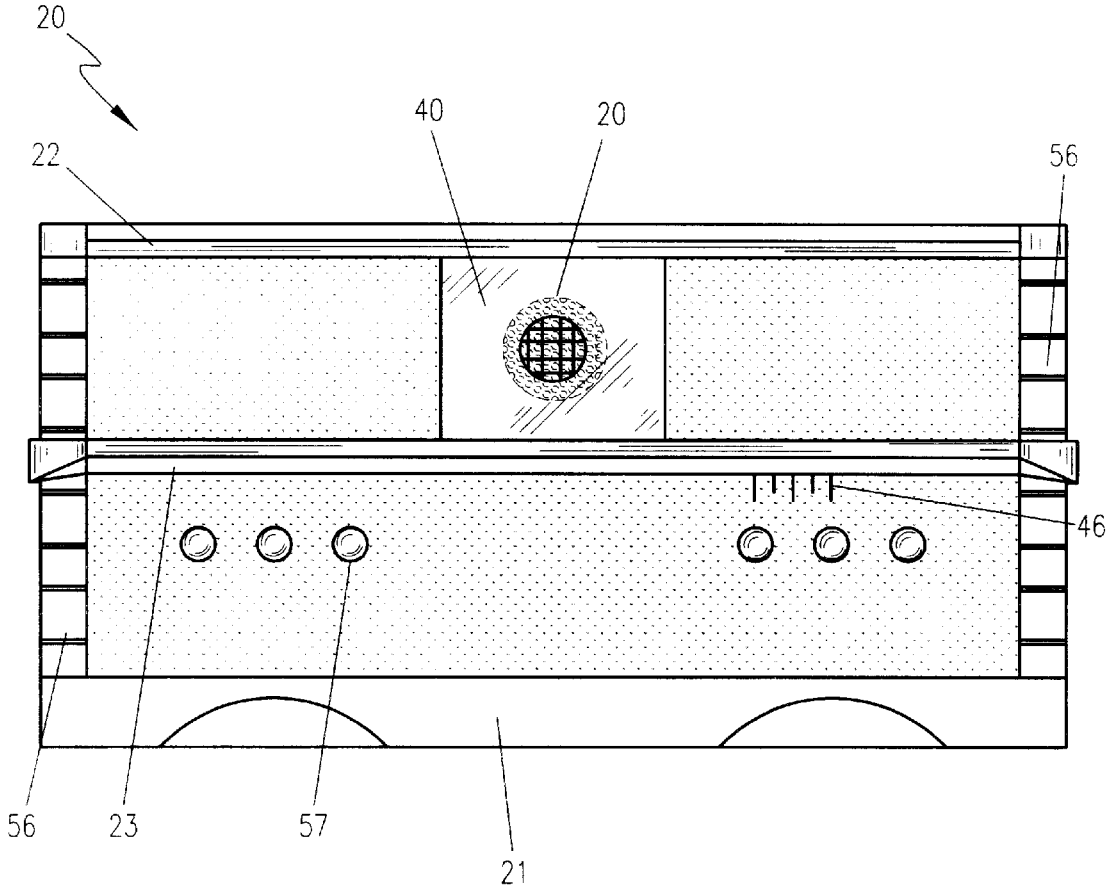
FIG. 7 is a top plan view of the putting stroke training device, depicting its use in supporting a golf ball for training purposes, according to the preferred embodiment of the present invention.
Figure 8:
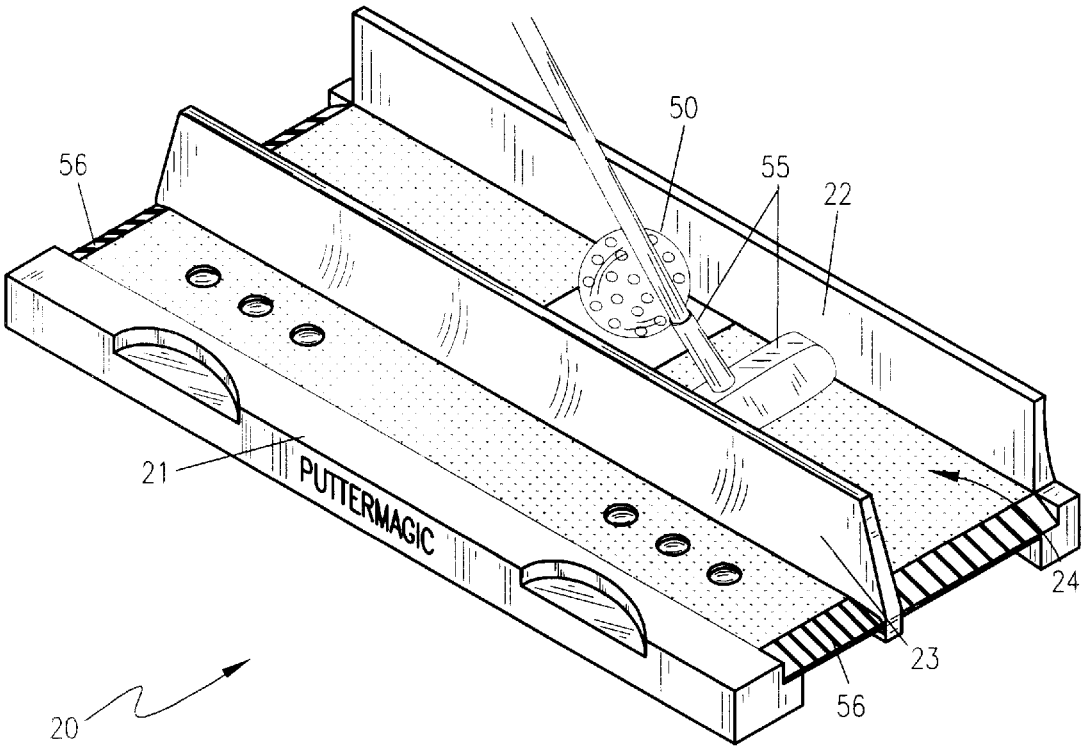
FIG. 8 is a perspective view of the putting stroke training device, depicting its use in training a proper putting stroke, according to the preferred embodiment of the present invention.
Figure 9:
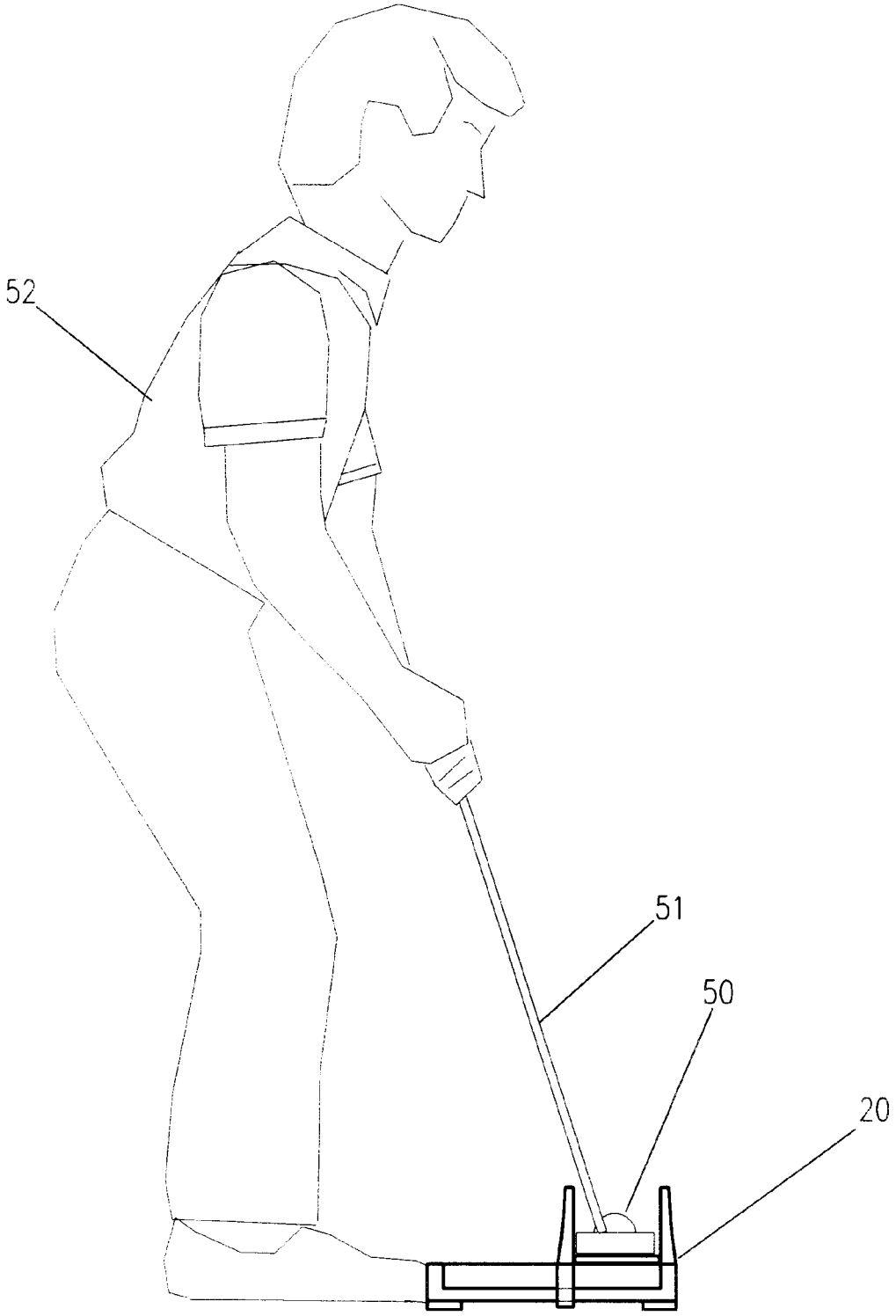
FIG. 9 is a side elevation view of the putting stroke training device, depicting its use in training a proper putting stroke, according to the preferred embodiment of the present invention.

In accordance with the preferred embodiment of the present invention and as shown in FIGS. 6–9, the putting stroke training device 20 is used to teach a proper putting stroke, allowing a user to perform an even level putter stroke with consistent speed and strength. Positioned within the golf ball holder 40, a golf ball 50 is placed in a position where it can be struck with a putter 51 from within the putting channel 24. The golfer 52 first adjusts the adjustable guide wall 23 such that the putter head 55 of the putter 51 fits within the putting channel 24 with a clearance of approximately ⅛–¼ inches. Placing his or her feet within the foot guides 29, the golf ball 50 is struck from within the putting channel 24, exiting the putting stroke training device 20 smoothly via an exit bevel 56 in the base 21.

The putting stroke training device 20 teaches a proper putting stroke by limiting the movement of the putter 51 within the putting channel 24 and by providing a gauge by which to practice putting speed and stroke strength. In adjusting the width of the putting channel 24 to slightly larger than the putter head 55, the golfer 52 is forced to swing the putter 51 in a level manner through the putting channel 24, so as not to strike the stationary guide wall 22 or the adjustable guide wall 23. As a result, the golfer 52 is trained to strike the golf ball 50 in perpendicular direction that results in the ball traveling in a straight direction, perpendicular to the surface of the putter head.

Many golfers strike the ball with an angled stroke, "across" the ball, causing it to spin and thus travel in an arcuate path. The putting stroke training device 20 remedies this tendency by forcing the golfer 52 to put within the putting channel 24. When the golfer 52 strikes the golf ball 50 without hitting either the stationary guide wall 22 or the adjustable guide wall 23, he or she knows that their swing is level. Other golfers strike the ball evenly, but position the putter in a non-perpendicular orientation causing the ball to travel in a mostly straight path but off-course to the left or right. The teaching device remedies this tendency by allowing the golfer 52 to monitor the travel of the golf ball 50 as is exits the putting channel 24. If the golf ball 50 travels at an angle within the putting channel 24 or strikes either the stationary guide wall 22 or the adjustable guide wall 23, they are alerted that the angle of the putter head 55 is in error.

The putting stroke training device 20 also helps to teach a golfer 52 to gauge his or her putting stroke speed or strength. The stroke strength indicia 46 allow the golfer 52 to monitor the distance in both the back-swing and follow-through in order to achieve the ability to strike the golf ball 50 in a consistent manner. The consistency in putting speed will allow the golfers 52, having gauged the putting surface, to place them in a position to propel the golf ball 50 a desired distance on a consistent basis.

Accordingly, the combination of true aim resulting from a smooth, even stroke, in conjunction with the consistent stroke speed produced by the putting stroke training device 20 will drastically improve one's golf game.

While the preferred embodiments of the invention have been shown, illustrated, and described, it will be apparent to those skilled in this field that various modifications may be made in these embodiments without departing from the spirit of the present invention. It is for this reason that the scope of the invention is set forth in and is to be limited only by the following claims.

What is claimed is:

1. A putting stroke training apparatus comprising:

a base having a generally elongated rectangular shape and having a first longitudinal edge opposite a second longitudinal edge and a first end opposite a second end;

a stationary guide wall affixed to said base along said first longitudinal edge and extending perpendicularly from said base, said stationary guide wall spanning the length of said base;

an adjustable guide wall slidably affixed to said base between said stationary guide wall and said second edge, said adjustable guide wall extending perpendicularly from said base, oriented parallel to said stationary guide wall, and adjustable such that the distance between said stationary guide wall and said adjustable guide wall can be varied, said stationary guide wall and said adjustable guide wall forming a putting channel therebetween;

guide wall securing means for securing said adjustable guide wall in a fixed position; and positioning means for positioning a golf ball within said putting channel, said positioning means being adjustable so as to allow for its placement centered within said putting channel.

2. The putting stroke training device of claim 1 wherein said base further comprises stroke strength indicia marked along the length of said putting channel for gauging the strength of a putting stroke.

3. The putting stroke training device of claim 1 wherein said base further comprises exit bevels located along said first end and along said second end, said exit bevels allowing a golf ball to exit said putting channel to an adjacent surface smoothly.

4. The putting stroke training device of claim 1 wherein said adjustable guide wall is slidably fastened to said base via slotted tabs formed on opposite ends of said base, and spring loaded grippers located integrally within the ends of said adjustable guide wall engage one of a plurality of tracks cut into a downwardly sloping surface cut into opposite ends of said base.

5. The putting stroke training device of claim 1 wherein said positioning means further comprises a pad having a shallow concave ball receiving cavity on the surface thereof.

6. The putting stroke training device of claim 1 wherein said base, said stationary guide wall and said adjustable guide wall are of a molded plastic construction having lightweight, strong and durable material properties.

7. The putting stroke training device of claim 1 wherein an upper surface of said base is covered with artificial grass.

* * * * *